United States Patent [19]

Hutzenlaub et al.

[11] 4,408,474

[45] Oct. 11, 1983

[54] METAL STRIP STRETCHING MILL

[75] Inventors: Armin S. P. Hutzenlaub, Wiehl; Willi Schmidt, Nümbrecht-Elsenroth, both of Fed. Rep. of Germany

[73] Assignee: Fa. Erwin Kampf GmbH & Co., Wiehl, Fed. Rep. of Germany

[21] Appl. No.: 282,275

[22] Filed: Jul. 10, 1981

[30] Foreign Application Priority Data

Jul. 10, 1980 [DE] Fed. Rep. of Germany ..... 3026129

[51] Int. Cl.[3] ..... B21B 39/08; B21B 35/14

[52] U.S. Cl. ..... 72/205; 72/249

[58] Field of Search ..... 72/29, 205, 243, 249, 72/444

[56] References Cited

U.S. PATENT DOCUMENTS 2,333,282 11/1943 Wilson ..... 72/183
3,595,055 7/1971 Rohde ..... 72/249
3,777,533 12/1973 Munchbach ..... 72/205
3,783,667 1/1974 Munchbach ..... 72/205
3,867,826 2/1975 Noe ..... 72/205

FOREIGN PATENT DOCUMENTS 2064561 7/1971 France.

*Primary Examiner*—Lowell A. Larson
*Assistant Examiner*—Jonathan L. Scherer
*Attorney, Agent, or Firm*—Joseph A. Geiger

[57] ABSTRACT

A metal strip stretching mill comprising a stretching station and, oppositely adjacent thereto, a group of pulling rolls and a group of braking rolls with adjustably speed-controlled drives on the rolls in the immediate vicinity of the stretching station and torque-controlled drives of stepped-up or stepped-down power on all other rolls, and a disconnectable clutch at the roll trunnion of at least one torque-controlled roll in the middle of each roll group, for a downward expansion of the usable power range of the installation through selective disconnection and idling of said rolls.

5 Claims, 1 Drawing Figure

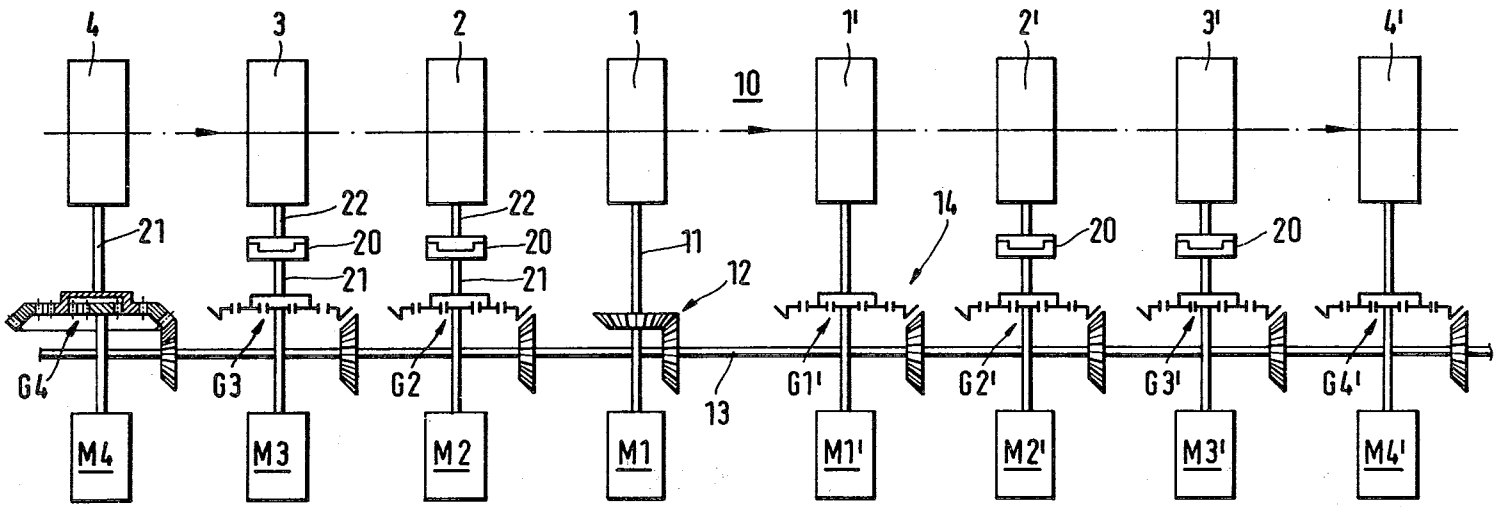
1
2
3
4
1'
2'
3'
4'
10
11
12
13
14
20
21
22
M1
M2
M3
M4
M1'
M2'
M3'
M4'
G1
G2
G3
G4
G1'
G2'
G3'
G4'

METAL STRIP STRETCHING MILL

BACKGROUND OF THE INVENTION

1. Field of the Invention

The invention relates to a metal strip stretching mill which has a stretching station and, arranged oppositely adjacent thereto, a group of pulling rolls and a group of braking rolls with at least two wrap-around rolls each, the pulling roll and the braking roll in the immediate vicinity of the stretching station having a controlled circumferential speed, and the other rolls having a torque-controlled drive with a power input which is stepped down in accordance with the distance of the roll from the stretching station.

2. Description of the Prior Art

Metal strip stretching mills of this type are used advantageously for the stretching of aluminum strip.

In this type of metal strip stretching mill, the rolls in the immediate vicinity of the stretching station have a controlled circumferential speed in order to thereby determine the overall speed of the mill and its stretch ratio. The other rolls are equipped either with separate, controllable drives or with differential drives, their torque input being determined as a function of their relationship to the rolls in the immediate vicinity of the stretching station. Electric motors for this kind of separate drive or differential drive of the individual rolls have normally a torque control range over their armature current of approximately 1 to 10. The individual rolls of each group contribute a stepped torque to the strip tension. At each successive roll, this tension is decreased or increased, as the case may be, by a fixed ratio of approximately 2.

One of the two groups of rolls must provide a step-down from the stretch tension to the drag tension of the supply shaft, the other from the stretch tension to the winding tension of the winding shaft. As a result, such an installation is controllable for reproducible process conditions only within a power range of 1 to 10. This signifies that, foı such a mill, the lowest power input acceptable must not lie below 10 percent of the maximum power input, or design power input.

Accordingly, when there is a need for processing thin, narrow and soft strip stock for which less than 10 percent of the design power output is required, it cannot be accomplished with such an installation. On the other hand, it is also not possible to simply disconnect individual drive motors, because of the sizeable power consumption of their drive train elements, especially their branching drives. The power losses under these circumstances would lead to completely undefinable situations.

SUMMARY OF THE INVENTION

It is an objective of the present invention to improve a metal strip stretching mill of the type described in such a way that the usable power range is extended and, more particularly, in such a way that it is possible to obtain reproducible process conditions, even with a small fraction of the design power output.

The invention proposes to attain the objective of an expanded usable power range by suggesting that one or more rolls of each group of rolls—other than its roll in the immediate vicinity of the stretching station—be connected to its associated drive shaft by means of a disconnectable clutch.

Accordingly, the suggested approach provides for some of the rolls to run idle, with virtually no friction forces, except for their negligible bearing friction. Thus, the invention makes it possible to considerably expand the usable power range of a given installation. In light of the extraordinary practical success of the invention, its proposed means of solution are of surprising simplicity. Nevertheless, the present invention is not an obvious outgrowth of the prior art, because it was impossible to anticipate the overwhelming success of the proposed measures.

Specifically, the invention suggests that the roll trunnion be connected directly to the clutch, in order to assure that, with the exception of bearing friction, no friction forces will affect the disconnected roll. The disconnection of one or more roll drives produces correspondingly higher loads on the remaining driven rolls, with the result that the drive motors have to produce a higher power output, thereby falling again within the reproducibly controllable power range.

In the case where a roll has to produce a very high torque, it is also possible to arrange the clutch on the input side of a reduction gear which is connected to the roll trunnion. This makes it possible to use a clutch of reduced torque capacity.

In an exemplary embodiment of the invention which relates to a metal strip stretching mill with four rolls in each roll frame, having power ratings stepped down at a step ratio of 1 to 2 and a control range for the torque of each roll—other than the one in the immediate vicinity of the stretching station—of approximately 1 to 10, the invention suggests the arrangement of a disconnectable clutch at the two rolls in the middle of each group of rolls.

It has been found that with this type of installation, when improved as proposed, it is possible to expand the range of applicability, i.e. the range of reproducible control, to 1 to 40, or down to one-fortieth of the design power output.

BRIEF DESCRIPTION OF THE DRAWING

In the following, an embodiment of the invention will be described with reference to the attached drawing which shows, in a schematic representation, a metal strip stretching mill for the processing of aluminum strip with its associated drive components.

DESCRIPTION OF THE PREFERRED EMBODIMENT

The drawing shows, in a schematic layout, a first roll group with four braking rolls 1, 2, 3 and 4 and a second roll group with four pulling rolls 1', 2', 3' and 4'. The rolls 1 and 1' are arranged in the immediate vicinity of a stretching station 10. The drawing also shows the direction of advance of the strip. The strip originates from a supply shaft which is not shown and is wound onto a winding shaft.

The roll 1 of the braking roll group is directly coupled to a main drive motor M1 which determines the processing speed of the entire installation. The shaft 11 of the main drive motor M1 drives a main drive shaft 13 by means of a bevel gear 12. The remaining rolls 2, 3 and 4 of the braking roll group are each driven by the main drive shaft 13, on the one hand, and by an auxiliary drive motor M2, M3 or M4, respectively, on the other hand. This drive utilizes differential gears G2, G3 and G4. In each case, the auxiliary drive motor drives the sun gear of the associated differential gear, while the crown gear is driven by the main drive shaft 13, via a bevel gear. Die drive shaft 21 of each roll is connected to the satellite support of the differential gear. The bevel gear drives are so arranged that the main drive shaft 13 is crossed over by the drive shafts of the main drive motor M1 and the auxiliary drive motors M2, M3 and M4. This type of gearing is known in detail, and it therefore requires no further elaboration. The drive shafts 21 of the braking rolls 2 and 3 are connected to the trunnions 22 of the rolls 2 and 3 by means of disconnectable clutches 20 which may be electromagnetic clutches, for example. Consequently, it is possible to completely interrupt the transmission of torque to the braking rolls 2 and 3 by means of the clutches 20, so that the rolls 2 and 3 rotate in an idling mode.

The first roll 1' of the pulling roll group is likewise controlled for an adjustable speed. It receives its drive from a bevel gear 14 and from an auxiliary drive motor M1' by means of a differential gear G1'. The rotational speed of the pulling roll 1' determines the stretch ratio in the stretching station 10. The other pulling rolls 2', 3' and 4' of the pulling roll group are arranged and interconnected in the same manner as the braking rolls 2, 3 and 4 of the braking roll group. The pulling rolls 2' and 3' are similarly equipped with disconnectable clutches 20.

The torques of the supply shaft and winding shaft (not shown) are coordinated with the strip traction produced by the rolls 4 and 4', respectively. Between the stretching station and the entry and exit sides of the stretching installation, each roll group must transform the stretching tension to the strip tension on the supply shaft and on the winding shaft, respectively.

In the following, an embodiment of the invention will be explained with the aid of a numerical example. A given strip stretching mill is designed to produce a maximum strip tension in its stretching station of 200000 N. Each roll group comprises four rolls by means of which the tension is successively increased, or decreased, as the case may be, by a factor of 2 per roll, so that the remaining tension of up to 12500 N can be generated as the winding tension of the winding shaft, or the braking tension of the supply shaft. Each roll, as well as the winding shaft and the supply shaft, has an adjustable drive torque with a control range of 1 to 10. The installation is to operate at a strip speed of 500 m/min. For this set of circumstances, it is possible to compute the strip tensions and, accordingly, the power requirements for the individual rolls, which are as follows:

| | | |
|---|---|---|
| Roll 1 | 100000 N | 816 KW |
| Roll 2 | 50000 N | 408 KW |
| Roll 3 | 25000 N | 204 KW |
| Roll 4 | 12500 N | 102 KW |

The total increase in strip tension for the four rolls thus amounts to a factor of 16. Because the control range for the installation is 1:10, the lowest stretching tension is 20000 N. Thinner, narrower, or softer strip stock, which can only withstand a lesser stretching tension, can therefore not be processed on this type of installation. This also takes into account that the rolls in the immediate vicinity of the stretching station are adjustable in their speed. Accordingly, when it becomes necessary for the stretching tension to be below the minimal tension values for the pulling and braking roll groups, a load reversal takes place at the rolls in the immediate vicinity of the stretching station, with the result that the meshing tooth flanks of the drive gears separate. A reproducible operation is thereby no longer possible.

Surprisingly, it has now been discovered that it is possible to greatly expand the operational range of such an installation in the downward sense by disconnecting certain rolls. Thus, it is possible to drive only two rolls of each roll group, so as to obtain a stretching tension range of between 5000 N and 50000 N. For this configuration, the computation of the tension increase at the first driven roll gives a power value of $$\frac{(50000 - 50000/2)\ 500}{61200} = 204\ \text{KW}$$

The value for the second driven roll is, accordingly:

$$\frac{(25000 - 25000/2)\ 500}{61200} = 102\ \text{KW}$$

These are the maximum power requirements on the two driven rolls. The two speed-adjustable rolls in the immediate vicinity of the stretching station must always be in driving engagement, because they determine the strip speed. The power value of 102 KW corresponds exactly to the power requirements of roll 4 and roll 4'. This signifies that, when only two rolls are to be used to obtain a strip tension rangand 4 are driven, while the rolls 2 and 3 are disconnected at their clutches 20.

Lastly, the use of three rolls offers an operational range of between 10000 N and 100000 N strip tension. The maximum power requirements for the three driven rolls are:

$$\frac{(100000 - 100000/2)\ 500}{61200} = 408\ \text{KW}$$

$$\frac{(50000 - 50000/2)\ 500}{61200} = 204\ \text{KW}$$

$$\frac{(25000 - 25000/2)\ 500}{61200} = 102\ \text{KW}$$

Comparing these power values with the earlier-mentioned maximum power ratings of the various rolls, it can readily be seen that this condition requires that the braking rolls 1, 3 and 4 and the pulling rolls 1', 3' and 4' be driven. The rolls 2 and 2', respectively, are disconnected at their clutches 20.

The foregoing numerical example clearly demonstrates how, through a simple improvement, it is possible to obtain a surprising expansion of the operational range of such an installation. This also means an extraordinary improvement in the economy of the installation. The advantages also include a reduction in the consumption of energy, because the latter can now be better adapted to the particular load conditions.

We claim the following:

1. A metal strip stretching mill comprising in combination:

a central stretching station;

a group of at least two pulling rolls adjoining the stretching station on one side, including a proximate pulling roll which is located in the immediate vicinity of the stretching station;

a similar group of at least two braking rolls adjoining the stretching station on the opposite side and including a proximate braking roll which is located in the immediate vicinity of the stretching station;

drive shafts connecting said two proximate rolls to a speed-adjustable drive means imparting to said proximate rolls an adjustable circumferential speed;

drive shafts connecting the non-proximate rolls of both groups of rolls to torque-adjustable drive means imparting to each of said non-proximate rolls an ajustable drive torque, or braking torque, respectively, the power input to the non-proximate rolls in each group being stepped down as a function of the distance of the particular roll from the stretching station; and a disconnectable clutch on the drive shafts of at least one non-proximate pulling roll and at least one non-proximate braking roll, said clutches being operable to switch said pulling and braking rolls to an idling mode, for a downward expansion of the effective power range of the metal strip stretching mill, through the selective idling of non-proximate rolls in both groups of rolls.

2. A metal strip stretching mill as defined in claim 1, wherein each of said idlable non-proximate rolls has a roll trunnion which is directly connected to one side of the associated disconnectable clutch.

3. A metal strip stretching mill as defined in claim 2, wherein each of said idlable non-proximate rolls includes, as part of its associated torque-adjustable drive means, a reduction gear; and the other side of said disconnectable clutch is directly attached to the reduction gear.

4. A metal strip stretching mill as defined in claim 1, wherein at least the idlable non-proximate pulling and braking rolls have as part of their drive means a differential gear with two separate drive inputs; and one of said drive inputs is derived from a separate drive motor which is adapted to be shut down, when the disconnectable clutch on the drive shaft of the idlable roll is disconnected.

5. A metal strip stretching mill as defined in any one of claims 1 through 4, wherein the group of pulling rolls and the group of braking rolls each comprises four rolls arranged in a roll frame;

the power input ratings of the drive means of the three non-proximate pulling rolls and of the three non-proximate braking rolls are stepped down at an approximate step ratio of one-to-two, and the drive means of each non-proximate roll has a torque adjustment range of approximately one-to-ten; and the two rolls in the middle of each group of rolls are idlable rolls, having disconnectable clutches on their drive shafts.

* * * * *